United States Patent [19]

Ogawa et al.

[11] Patent Number: 4,642,210

[45] Date of Patent: Feb. 10, 1987

[54] ROTARY CORDIERITE HEAT REGENERATOR HIGHLY GAS-TIGHT AND METHOD OF PRODUCING THE SAME

[75] Inventors: Yutaka Ogawa; Shunichi Yamada, both of Nagoya; Toshiyuki Hamanaka, Suzuka, all of Japan

[73] Assignee: NGK Insulators, Ltd., Japan

[21] Appl. No.: 651,857

[22] Filed: Sep. 18, 1984

Related U.S. Application Data

[62] Division of Ser. No. 540,306, Oct. 11, 1983, Pat. No. 4,489,774.

[30] Foreign Application Priority Data

Dec. 29, 1982 [JP] Japan ..... 57-230057

[51] Int. Cl.[4] ..... C04B 35/84; C04B 41/87

[52] U.S. Cl. ..... 264/62; 264/60; 428/307.7

[58] Field of Search ..... 165/8, 10; 65/60.53, 65/60.55; 428/307.7; 501/128; 264/60, 62

[56] References Cited

U.S. PATENT DOCUMENTS

| | | | |
|---|---|---|---|
| 3,873,350 | 3/1975 | Dwyer et al. . | |
| 3,885,942 | 5/1975 | Moore . | |
| 3,948,317 | 4/1976 | Moore | 165/10 |
| 4,333,518 | 6/1982 | Frost et al. | 165/8 |
| 4,335,783 | 6/1982 | McBrayer et al. | 165/8 |
| 4,357,987 | 11/1982 | Oda et al. | 165/10 |
| 4,381,845 | 5/1983 | Frost et al. | 165/8 |

FOREIGN PATENT DOCUMENTS

| | | |
|---|---|---|
| 0042302 | 12/1981 | European Pat. Off. . |
| 0082608 | 6/1983 | European Pat. Off. . |
| 2031571 | 4/1980 | United Kingdom . |
| 2064360 | 6/1981 | United Kingdom . |
| 2071639 | 9/1981 | United Kingdom . |

OTHER PUBLICATIONS

Ceramic Regenerator Systems Development Program–Final Report, DOE/NASA/008,12, Oct. 1980.

*Primary Examiner*—Albert W. Davis, Jr.
*Attorney, Agent, or Firm*—Parkhurst & Oliff

[57] ABSTRACT

Highly gas-tight rotary cordierite heat regenerator is formed of a honeycomb structural body having a porosity of 20–45% and mainly consisting of cordierite, and open pores of the partition walls defining channels of the honeycomb structural body are sealed with a filler thereto, the difference of thermal expansion between the honeycomb structural body and the filler being less than 0.1% at 800° C. The honeycomb structural body is made by preparing fired segments thereof, sealing the open pores of the partition walls with the filler thereof, bonding the segments with a ceramic bonding material, and firing the bonded segments.

7 Claims, 8 Drawing Figures

10μ

10μ

ROTARY CORDIERITE HEAT REGENERATOR HIGHLY GAS-TIGHT AND METHOD OF PRODUCING THE SAME

This is a division of application Ser. No. 540,306 filed Oct. 11, 1983, now U.S. Pat. No. 4,489,774.

BACKGROUND OF THE INVENTION

1. Field of the Invention

This invention relates to a rotary cordierite heat regenerator and a method of producing the same. More particularly, the invention relates to a rotary cordierite heat regenerator based on a honeycomb structural body which has been used as industrial heat exchangers or as a part of internal combustion engines or external combustion engines such as gas turbine engines and Stirling's air engines.

2. Description of the Prior Art

In general, a rotary ceramic heat regenerator comprises a cylindrical matrix of honeycomb structure with a diameter of 30–200 cm and a matrix-holder ring to be fitted on the outer circumference of the cylindrical matrix, and the heat regenerator is rotated in a two-passage chamber, which chamber is divided into two sections by a dividing means, i.e. a section defining a heating fluid passage and another section defining a recovering fluid passage. The heat regenerator rotating has a chamber divided into two section defining a heating fluid passage and another section defining a recovering fluid passage, and it cyclically repeats the storing and the releasing heat in the chamber for facilitating heat exchange.

Thus, for manifesting characteristics of the rotary ceramic heat regenerator, it is required to have a high heat exchange efficiency and a low pressure loss so as to ensure smooth passage of heating and recovering fluids therethrough.

A typical ceramic rotary heat regenerator of the prior art is disclosed by the U.S. Pat. No. 4,304,585. This U.S. Patent teaches a method of producing a rotary ceramic heat regenerator by firing a plurality of matrix segments of honeycomb structural body, bonding the thus fired matrix segments to form a rotary heat regenerator by a ceramic bonding material having substantially the same mineral composition as that of the matrix segments after firing, the ceramic bonding material having a thermal expansion that is less different from that of the matrix segments after firing, and firing the thus bonded matrix segments. Of the rotary ceramic heat regenerators thus produced by the method of this U.S. Patent, a rotary cordierite heat regenerator has a particularly high thermal shock resistance because it has a small coefficient of thermal expansion. Besides, the rotary cordierite heat regenerator thus produced has a high chemical inertness which has been experienced in those lithium aluminosilicates, such as $\beta$-spodumene, which have a similar low thermal expansion to that of cordierite.

Generally speaking, it is difficult to sinter cordierite to a dense structure. Especially, in case of low-expansion cordierite body with a coefficient of thermal expansion smaller than $2.0\times10^{-6}$/°C. over a range of room temperature to 800° C., the content of fluxing ingredients such as calcia, alkali, potash, soda, and the like must be limited to a very low level, so that vitreous phase therein is very scarce and the cordierite tends to become porous. More particularly, cordierite honeycomb structural bodies which have been used in recent years as catalyst-carriers for purifying automobile exhaust gas are required to have a coefficient of thermal expansion smaller than $1.5\times10^{-6}$/°C. over a range of room temperature to 800° C., so that the porosity of the sintered cordierite body is 20–45% at the least even if the starting materials, such as talc, kaolin, alumina or the like including the place of their production, their chemical composition, their particle size, and the like, are carefully selected to have only a small amount of impure ingredients. Accordingly, a rotary cordierite heat regenerator made of the above-mentioned cordierite matrix of honeycomb structural body has a serious problem of low heat exchange efficiency because fluid leakage is likely to occur between the heating fluid passage and the recovering fluid passage leading therebetween or through open pores of the partition walls defining the channels of the honeycomb structural body. The low heat exchange efficiency of the rotary heat regenerator tends to deteriorate the overall heat exchange efficiency of a large system having such a rotary heat regenerator.

On the other hand, if the porosity of cordierite is reduced, the thermal expansion thereof tends to increase. For instance, British Patent Specification GB-2071639A proposes a method of reducing the porosity by applying a glaze or the like on the surface of partition walls defining channels of the porous honeycomb structural body. This method has a shortcoming in that the flux components contained therein tend to cause a large increase of the thermal expansion and deteriorate the thermal shock resistance. Conventional methods of producing cordierite matrix segments of honeycomb structural body with a comparatively low porosity have a shortcoming in that a large shrinkage is caused in the drying and firing stages, and such shrinkage tends to form cracks in the segments. Accordingly, it has been difficult to produce large matrix segments with a reasonably high yield.

SUMMARY OF THE INVENTION

Therefore, a first object of the present invention is to obviate the above-mentioned shortcomings of the prior art by providing an improved rotary cordierite heat regenerator with a high gastightness. In the rotary cordierite heat regenerator of the invention, the thermal expansion is very low, so that it is possible to greatly reduce the fluid leakage through the matrix partition walls of honeycomb structural body thereof without deteriorating its resistance to thermal shock. Whereby, the heat exchange efficiency of the heat regenerator is considerably improved, and the overall efficiency of a thermal system including such a heat regenerator is also improved.

A second object of the invention is to provide a method of producing the above-mentioned rotary cordierite heat regenerator with a high gastightness.

A preferred embodiment of the rotary cordierite heat regenerator with a high gastightness according to the present invention comprises a honeycomb structural body with a porosity of 20–45%, said honeycomb structural body consisting of cordierite, open pores of partition walls of said honeycomb structural body defining channels thereof having substances of a filler thereto so as to be sealed thereby, the difference of thermal expansion between the honeycomb structural body and the filler being less than 0.1% at 800° C. In a preferred method of producing a rotary cordierite heat regenerator with a high gastightness according to the present invention, cordierite matrix segments of honeycomb structural body are shaped and fired; substances of a filler are applied onto open pores of partition walls defining channels in the matrix segments, the difference of thermal expansion between said filler and said matrix segments after firing being less than 0.1% at 800° C.; an bonding material is applied on certain surface portions of said matrix segments matrix body, said bonding material containing cordierite as a major crystalline phase ingredient thereof after firing, the difference of thermal expansion between said bonding material and said matrix segments after firing being less than 0.1% at 800° C.; and the thus bonded unitary matrix body of honeycomb structural body is fired at 1,350°-1,430° C. In the above-mentioned method, the sequence of the sealing the open pores of the partition walls with filler and application of the bonding material followed by bonding may by interchanged, i.e, the filler may be applied after bonding the matrix segments to the unitary matrix body.

BRIEF DESCRIPTION OF THE DRAWING

For a better understanding of the invention, reference is made to the accompanying drawings, in which.

Throughout different views of the drawings, 1 is a rotary cordierite heat regenerator of heat accumulator type, 2 is a matrix segment, 3 is a partition wall of the matrix, 4 is a open pore, 5 is a filler, 6 is a channel, and 7 is a bonding material.

DESCRIPTION OF THE PREFERRED EMBODIMENTS

Figure 1:
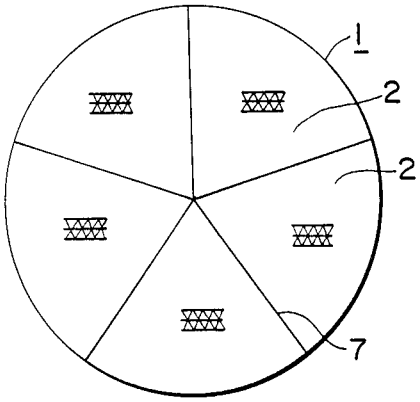
FIG. 1 is a schematic plan view of a rotary cordierite heat regenerator according to the present invention.
Figure 2:
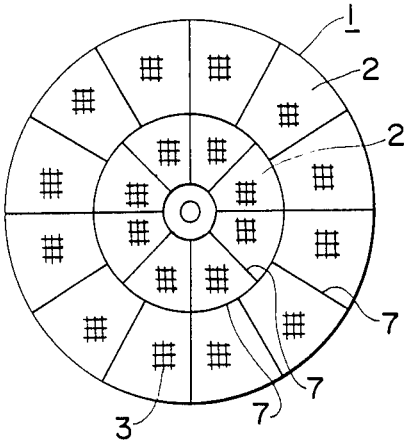
FIG 2 is a view similar to FIG. 1, showing another rotary cordierite heat regenerator according to the present invention.
Figure 3:
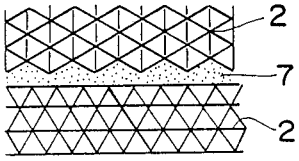
FIGS. 3 and 4 are diagrammatic illustrations of the manner in which adjacent matrix segments are bonded.
Figure 4:
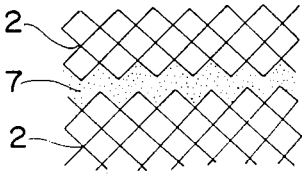
Figure 5:
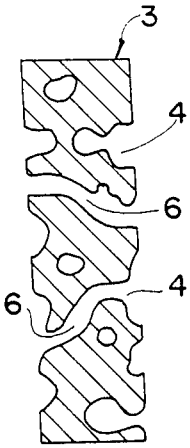
FIG. 5 is a schematic sectional view of a partition wall of a porous cordierite matrix segment before applying filler substances thereto.
Figure 6:
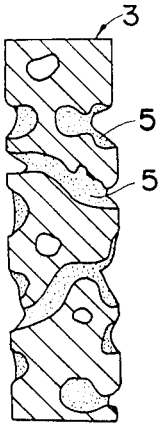
FIG. 6 is a view similar to FIG. 5, showing the manner in which open pores of the partition wall are sealed with a filler thereto by the method according to the present invention.

Referring to FIG. 1 and FIG. 2, a rotary cordierite heat regenerator 1 of heat accumulator type comprises a plurality of matrix segments 2 of honeycomb structural body, each of which matrix segments 2 mainly consists of cordierite. The reason why the major ingredient of the matrix segment 2 is cordierite is its low thermal expansion characteristics providing an excellent resistance to thermal shock and a high softening point over 1,200° C. providing a high heat resistance. To ensure the high resistance to thermal shock, the matrix segmenet 2 is made of a low-expansion cordierite of honeycomb structural body with a porosity of 20–45%, which is for instance similar to what is used as a catalyst-carrier for purifying automobile exhaust gas. Adjacent matrix segments 2 are integrally bonded one to the other by cordierite-base bonding material 7, as shown in FIG. 3 and FIG. 4. In the embodiment of FIG. 1, five matrix segments 2 are integrally bonded to form the heat regenerator 1, while in the embodiment of FIG. 2, twenty matrix segments 2 are integrally bonded to one regenerator 1. According to the present invention, the number of matrix segments 2 per one heat regenerator 1 can be determined depending on the required dimensions and shape of the heat regenerator 1 while taking into consideration the conditions for producing the individual matrix segments 2 therefor, such as the dimentions of metallic moulds for extrusion shaping thereof. Referring to FIG. 5, each matrix segment 2 has partition walls 3 (only one is shown in the figure) which define channels of the segmenet 2 and have open pores 4 formed on the surface thereof. The partition wall 3 also has channels 6 extending therethrough so as to provide fluid passages across the partition wall 3. According to the present invention, both the channels 6 and open pores 4 by sealing the open pores with a filler 5 therein, as shown in FIG. 6. More particularly, channels 6 are blocked by the filler 5 so as to prevent the heating fluid or recovering fluid from passing therethrough. The filler 5 consists of such cordierite and glass substance that the difference of thermal expansion between the filler 5 and the matrix segment 2, or between the filler 5 and the matrix partition wall 3 of the cordierite honeycomb structural body, is less than 0.1% at 800° C. The reason why the difference of thermal expansion between the filler 5 and the matrix segement 2 is selected to be less than 0.1% at 800° C. is in that, if such difference exceeds 0.1%, the difference of the thermal expansions between the filler 5 and the matrix segment 2 becomes too large and the resistance to thermal shock the rotary cordierite heat regenerator 1 is deteriorated.

The method of producing the cordierite heat regenerator according to the present invention will be described now in four stages; i.e., shaping and firing of cordierite matrix segments, sealing open pores of the partition wall with a filler of the matrix segments bonding of the matrix segments to a unitary body, and firing the unitary body.

(1) Stage of shaping and firing of cordierite matrix segments:

A cordierite body is prepared by using a conventional low-expansion cordierite material batch, i.e., starting material powder particules with little impurities such as talc, kaolin, alumina, and the like, and a suitable binder and the like. One or more honeycomb structural bodies of suitable dimension and shape for a desired heat regenerator are formed by extruding the thus prepared cordierite body. When the size of the desired heat regenerator is large, it is formed as a combination of segments of honeycomb-structure as shown in FIG. 1 and FIG. 2. The one or more honeycomb structural bodies or segments of the cordierite material batch are fired at a cordierite firing temperature, in a range of 1,350°-1,430° C., so as to produce one or more low-expansion cordierite matrix segments. The material batch and the firing conditions should be such that the fired cordierite matrix segments have a porosity of 20–45%.

(2) Stage of sealing open pores with a filler in matrix partition walls:

In this stage, a filler consisting of cordierite powder particles and ceramic powder particles convertible to glass substances upon firing is applied into open pores of the partition wall in the low-expansion cordierite matrix segments produced in the preceding stage.

Preferably, the cordierite powder particles of the filler are substantially the same as the material of the cordierite matrix segments. However, any other low-expansion cordierite material with little impurities can be used as the cordierite powder particles of the filler. The cordierite powder particles should be sufficiently supplied for effectively suppressing the leakage across the matrix partition wall to a minimum, so that the preferable amount of the cordierite powder particles to be applied is 5–30%, more preferably 10–20%.

To prevent the ceramic powder particles convertible to glass substances upon firing from both reacting with the cordierite matrix during the firing and deteriorating the heat resistance of the matrix having open pores thereof sealed with the filler, such ceramic powder particles convertible to glass substances upon firing should contain only limited amounts of flux, such as calcia, alkali, and the like. Preferably, the flux is suitably selected from the Seger formula of the glass composition of cordierite system, depending on the firing temperature for sealingly bonding the filler, the sealing method, and the amount of application; the Seger formula consisting of 0.03–0.15 of KNaO, 0.80–0.94 of MgO, 0.01–0.04 of CaO, 0.92–0.96 of $Al_2O_3$, and 2.47–3.92 of $SiO_2$. If the content of flux in the ceramic powder particles convertible to glass substances is too large, its reaction with the cordierite matrix partition walls takes place during the firing, resulting in an adverse effect of increasing the thermal expansing of the matrix. On the other hand, if the filler contains only the cordierite powder particles, or if the content of the flux in the ceramic powder particles convertible to glass substances is too small, the bondage of the filler to the surface of the open pores of the matrix partition wall becomes too weak and sufficient prevention of the leakage cannot be achieved. That amount of the ceramic powder particles convertible to glass substances for sealing upon firing should be determined depending on the chemical composition thereof. The preferable amount of such ceramic powder particles for sealing is 3–25%, more preferably 5–15%, so as to ensure that the difference of thermal expansion between the cordierite matrix and the filler after firing is less than 0.1% at 800° C.

The size of the cordierite powder particles and the ceramic powder particles convertible to glass substances upon firing, in the filler for sealing, must be very fine and smaller than 44 μm, because such powder particles must be applied not only to minute open pores of the partition walls of the cordierite matrix, but also to deep inside portions of such matrix partition walls for fully sealing channels therein. If the particle size is larger than 44 μm, such powder particles are not applied to the inside of the open pores but deposited on the entire surfaces of the matrix partition walls, resulting in adverse effects of insufficient prevention of the leakage and unnecessary increase of the thickness of the matrix partition wall which causes an increased pressure loss.

Several methods are available for applying the cordierite powder particles and the ceramic powder particles convertible to glass substances upon firing: namely, a method in which a slip is prepared by adding water into the finely ground particles of cordierite and ceramic powder particles convertible to glass substances upon firing, a matrix segment is dipped in the slip, pulled out of the slip for removing excess slip by aeration, and dried, and if necessary, the steps from the dipping to the drying of the matrix segment are repeated until a certain amount of such powder particles are applied thereto; a method in which a matrix segment is placed in an air-tight vessel, so that after the vessel is evacuated, the above-mentioned slip is introduced into the vessel for immersing the matrix segment in the slip, and then the matrix segment is removed from the vessel; and a method in which the above-mentioned slip is atomized and blown onto the matrix segment. As to the sequence of applying of the cordierite powder particles and the ceramic powder particles convertible to glass substances upon firing, it is preferable to apply the condierite powder particles at first and then the ceramic powder particles convertible to glass substances upon firing, from the standpoint of prevention the reaction of the flux substances with the cordierite matrix. When the filler is applied by dipping the matrix segment into the slip containing both the cordierite powder particles and the ceramic powder particles convertible to glass substances upon firing, it is necessary to more strictly limit the amount of the ceramic powder particles convertible to glass substances upon firing or the amount of the flux component than in the case of the above-mentioned successive application.

(3) Stage of bonding the matrix segments:

This stage is to integrally bond a plurality of fired matrix segments by a bonding material so as to produce a unitary cordierite body for the desired rotary cordierite heat regenerator of given dimension. Referring to FIG. 3 and FIG. 4, bonding material 7 is applied in a layer to certain surfaces of the matrix segments 2 which have triangular or rectangular channels, so that the matrix segments 2 are integrally bonded by the layer of bonding material 7.

The bonding material 7 is such that, when the bonded matrix segments 2 are fired in the next stage, the major ingredient of the crystalline phase of the bonding material 7 becomes cordierite, and the difference of the thermal expansion between the bonding material 7 and the matrix segments 2 is less than 0.1% at 800° C. The bonding material 7 is made in a paste form by adding a binder and water into a cordierite material batch, and kneading the mixture. The bonding material paste is spread onto certain outer surfaces of the matrix segments, and the matrix segments are bonded at the certain surfaces with the bonding spreaded thereon, and the bonding material is dried after the bonding. The thickness of the layer of the bonding material is such that, after the firing, the bonding material layer does not cause any increase of pressure loss in the fluid flowing through the heat regenerator while ensuring sufficient strength at the bonded portions, and the preferable thickness of the bonding material is 0.1–6 mm, more preferably 0.5–3 mm. To ensure a high resistance to thermal shock of the integrally bonded heat regenerator after firing, the difference of thermal expansion between the matrix segment and the bonding material after firing should be less than 0.1%, more preferably less than 0.05%. The reason for this restriction is in that when the above-mentioned difference of the thermal expansion is larger than 0.1%, cracks are likely to be caused from the bonded portions of the matrix segments when thermal impact is applied thereto.

The bonding of the matrix segments may be effected either before or after the application of the filler. The sequence of the bonding and the sealing can be determined depending on the size of the matrix segments and the heat regenerator. For instance, to make a big heat regenerator, the filler may be applied onto the matrix segments and then the matrix segments may be integrally bonded.

(4) Stage of firing:

In this stage, the matrix segments sealed with filler substances thereto and bonded to a unitary cordierite body are fired.

The matrix segments which have been integrally bonded after applying the filler therein are fired at 1,350°–1,430° C., so as to seal the open pores of the partition walls of the matrix with the filler and to convert the bonding material into cordierite. The firing of the low-expansion cordierite at 1,350°–1,430° C. gives a sufficient reduction of the thermal expansion of the filler and results in sufficiently strong bondage of the filler with the matrix segments. Since the bonding material consists of cordierite materials, the conversion of the bonding material into cordierite is achieved by the firing. The reason for selecting the above-mentioned temperature range for the firing is in that, if the firing temperature is below 1,350° C., sufficient reduction of the thermal expansion of the filler and the segment bondage cannot be achieved, while if the firing temperature is above 1,430° C., undesirable reaction between the flux components of the filler and the cordierite matrix segments occurs and adverse effects of an increased thermal expansion of the filler and the bondage is caused.

Although it is preferable to simultaneously effect the firing of both the filler and the bonding material from the standpoint of minimizing the number of firing operations, separate firings may be effected after the applying of the filler and after the bonding with the bonding material respectively.

Now, practical examples of the present invention will be described.

EXAMPLE 1

Specimens a to e of matrix segments of honeycomb structural body for heat regenerators with porosities of 20–47.8% as shown in Table 1 were prepared by selecting suitable particle sizes of starting materials, suitable combinations and concentrations of different materials, and suitable concentrations of binders in the following manner: namely, matrix segments of honeycomb structural body with triangular cells at a pitch of 1.4 mm with 0.12 mm thick partition walls were formed by extrusion of different cordierite material batches which consisted of Chinese talc, calcined Chinese talc, Georgia kaolin, calcined Georgia kaolin, alumina, and aluminum hydroxide; and the thus prepared matrix segments were fired for four hours with a maximum temperature of 1,400° C., so as to form matrix segments having a cross-section of 130 mm by 180 mm and a height of 85 mm. The porosities, thermal expansion, resistance to thermal shock, and leakages in the matrix segments thus formed were measured. The result of the measurement is shown in Table 1. The leakage across the matrix partition walls in Table 1 was determined by a method which was disclosed in page 213 of "CERAMIC REGENERATOR SYSTEMS DEVELOPMENT PROGRAM-FINAL REPORT", DOE/NASA/0008-12, NASA CR-165139, a publication of the U.S.A.; more particularly, a 38.1 mm wide rubber gasket having a groove at a central portion thereof, the groove being 3.2 mm wide and 152.4 mm long, was attached to one end surface of the matrix segment of honeycomb structural body, while a seal was attached to the opposite end surface thereof for preventing any leakage therethrough, and pressurized air at 138 KPa, i.e., about 1.4 kg/cm$^2$, was introduced through the groove of the above-mentioned rubber gasket, and the flow rate of the pressurized air was measured and the leakage (kg/sec·m$^2$) was calculated therefrom. It was not possible to obtain cordierite matrix segments having a porosity of smaller than 20%, because cracks were caused in the drying and firing stages of preparing samples of such matrix segments. As can be seen from Table 1, Specimen e with a porosity of larger than 45% had a high thermal expansion and a very low thermal shock resistance, so that it was not suitable for use as the matrix segments of the heat regenerator of the invention.

TABLE 1

| Properties of cordierite matrix segments* | | | | | |
|---|---|---|---|---|---|
| Specimen | a | b | c | d | e |
| Porosity (volume %) | 20.0 | 32.5 | 34.7 | 45.0 | 47.8 |
| Thermal expansion (%) at 800° C. | 0.082 | 0.057 | 0.068 | 0.089 | 0.120 |
| Cracks when removed from an electric furnace at 750° C., indicating the thermal shock resistance | None | None | None | None | Exist |
| Leakage (kg/sec · m$^2$) under pressure of 1.4 kg/cm$^2$ | 0.026 | 0.042 | 0.045 | over 0.1 | over 0.1 |

*Each matrix segment had a cross-section of 130 mm by 180 mm and a height of 85 mm.

TABLE 2

| Properties of matrix segments (130 × 180 × 85 mm) being sealed with filler applied thereto | | | | | | | |
|---|---|---|---|---|---|---|---|
| | | Invention | | | Reference | | |
| Specimen | | 1 | 2 | 3 | R1 | R2 | R3 |
| Amount of filler applied (Wt %) | Cordierite powder particles (−44 μm) | 12.8 | 14.5 | 10.3 | — | — | 5.8 |
| | Cordierite powder particles (−74 μm) | — | — | — | 13.1 | — | — |
| | Ceramic powder particles A (−44 μm) | — | 8.9 | — | 10.9 | | 18.9 |
| | Ceramic powder particles B (−44 μm) | 10.8 | — | 8.8 | — | 15.0 | — |
| (X) Thermal expansion (%) of matrix segment at 800° C. before applying filler | | | | 0.068 | | | |
| Properties of matrix segment after firing at 1,400° C. for 4 hours | Thickness of matrix partition wall (mm) | 0.12 | 0.12 | 0.12 | 0.14 | 0.12 | 0.12 |
| | (Z) Thermal expansion (%) of filler* at 800° C. | 0.143 | 0.168 | 0.133 | 0.172 | 0.213 | 0.188 |
| | Difference of thermal expansion (Z) − (X) (%) | 0.075 | 0.100 | 0.065 | 0.104 | 0.145 | 0.120 |
| | Thermal expansion of matrix at 800° C. (%) | 0.071 | 0.075 | 0.070 | 0.093 | 0.126 | 0.099 |
| | Cracks, (thermal shock resistance)** | none | none | none | exist | exist | exist |

TABLE 2-continued

| Specimen | Properties of matrix segments (130 × 180 × 85 mm) being sealed with filler applied thereto | | | | | |
|---|---|---|---|---|---|---|
| | Invention | | | Reference | | |
| | 1 | 2 | 3 | R1 | R2 | R3 |
| Leakage (kg/sec · $m^2$) under 1.4 kg/$cm^2$ | 0.020 | 0.017 | 0.025 | 0.030 | 0.033 | 0.014 |

Notes:
*Measurement was taken on 55 mm long fired test pieces.
**Thermal shock resistance was determined by checking cracks when the matrix segment was removed from an electric furnace at 750° C.

TABLE 3

| Substances | Composition of ceramic powder particles convertible to glass substances upon firing | | | | |
|---|---|---|---|---|---|
| | Seger formula | | | | |
| | KNaO | CaO | MgO | $Al_2O_3$ | $SiO_2$ |
| Ceramic powder particles A | 0.09 | 0.03 | 0.88 | 0.93 | 3.35 |
| Ceramic powder particles B | 0.06 | 0.03 | 0.91 | 0.94 | 2.62 |

Different fillers as shown in Table 2 were applied to the matrix segment Specimens c with a porosity of 34.7% as shown in Table 1; more particularly, each Specimen c was dipped in a slip containing the cordierite powder particles of Table 2 and 50% of water, and then in a slip containing the ceramic powder particles A or B of Table 2 and 50% of water, the ceramic power particles being convertible to glass substances upon firing, while excess slip was removed and the Specimen was dried after each dipping, and the dipping and the drying were repeated by a certain number of times so as to apply the filler onto the Specimen. The removal of the slip was effected by aeration until the slip is removed from all the channels of the honeycomb structural body so that no plugging of the channels was left after the aeration. The mean values of the measured amounts of the fillers applied to the Specimens are shown in Table 2. The chemical compositions of the ceramic powder particles A and B of the filler are shown in Table 3. The thermal expansion of the filler in Table 2 was measured by preparing a 55 mm long test piece for each of the filler substances, firing the test piece under the same firing conditions as those of the matrix segments, and taking measurement of the thus fired test piece; which test piece was prepared by applying the cordierite powder particle slip and the slip of the ceramic powder particles convertible to glass substances upon firing onto a porous water absorbing board at the same ratio as that for sealing the powder particles to the matrix segment, and drying the powder particles thus applied.

The matrix segments carrying the filler applied thereto and the test pieces of the filler substances were fired with a maximum temperature of 1,400° C. for four hours. Measurements were taken on the properties of the matrix segments thus fired; namely, the thickness of the matrix partition wall, the thermal expansion, resistance to thermal shock, and the leakage. The result of the measurement is shown in Table 2, together with the measured values of the values of the thermal expansion of the filler substances. In Table 2, the filler of reference Specimen R1 consisted of cordierite powder particles of coarce particle size (−74 μm), the filler of reference Specimen R2 solely consisted of ceramic powder particles convertible to glass substances upon firing, and the filler of reference Specimen R3 had a difference of thermal expansion larger than 0.1% at 800° C. between the filler and the matrix segment before application the filler thereto. The reference Specimens R1 and R2 had larger leakages than that of the present invention as shown in Table 2, and the reference Specimens R1, R2, and R3 proved to have considerably larger thermal expansion and inferiror resistance to thermal shock as compared with those obtained by the Specimens of the present invention.

EXAMPLE 2

The fillers of Specimens No. 1 through No. 5 of the invention and reference Specimens R No. 1 and R No. 2 as shown in Table 4 were apply to the cordierite matrix segment Specimens c of Table 1 of Example 1 in a manner similar to that of Example 1. Table 4 also shows the average values of the measured amounts of different substances of the fillers apply to the matrix segments. After application the fillers, 13 matrix segments of each of the Specimens No. 1 through No. 5 of the invention and the reference Specimens R No. 1 and R No. 2 of Table 4 were suitably machined, and a pasty bonding material was applied to bonding surfaces of the matrix segments so that the thickness of the bonding material after the firing would be about 1.5 mm, and the matrix segments of each Specimen were integrally bonded into a bonded matrix body of unitary structure. The pasty bonding material consisted of Chinese talc, Georgia kaolin, calcined Georgia kaolin, and alumina. After thoroughly dried, the bonded matrix body of unitary structure for the Specimens No. 1 through No. 5 of the invention and reference Specimens R No. 1 and R No. 2 were fired under the conditions as listed in Table 4 respectively, so as to product rotary cordierite heat regenerators, each of which had a diameter of 450 mm and a thickness of 85 mm. Test pieces for measuring the thermal expansion of the bonding material and the filler substances were prepared in a manner similar to that of Example 1, and the thermal expansion were measured.

Table 4 shows the results of the measurements of various properties; namely, the thermal expansion of the bonding material, the filler substances, and the matrix, the thermal shock resistance of the heat regenerators, and the leakage in the matrix.

TABLE 4

| Specimen | | Reference | Invention | | | | | Reference |
|---|---|---|---|---|---|---|---|---|
| | | R No. 1 | No. 1 | No. 2 | No. 3 | No. 4 | No. 5 | R No. 2 |
| Firing | Temperature (°C.) | 1340 | 1350 | 1380 | 1400 | 1420 | 1430 | 1435 |
| | Duration (hours) | 8 | 8 | 6 | 4 | 4 | 1 | 1 |
| Amount of filler applied (Wt %) | Cordierite powder particles (−44 μm) | 10.5 | 9.8 | 10.8 | 12.8 | 18.2 | 20.3 | 20.9 |
| | Ceramic Powder particles A (−44 μm) | 16.0 | 15.0 | — | — | — | — | — |
| | Ceramic powder particles B (−44 μm) | — | — | 14.2 | 10.8 | 8.1 | 5.0 | 4.5 |

TABLE 4-continued

| Specimen | | Reference R No. 1 | Invention No. 1 | No. 2 | No. 3 | No. 4 | No. 5 | Reference R No. 2 |
|---|---|---|---|---|---|---|---|---|
| (X) Thermal expansion (%) of matrix segment at 800° C. before applying filler | | | | | 0.068 | | | |
| (Y) Thermal expansion (%) of bonding material at 800° C.* | | 0.180 | 0.160 | 0.092 | 0.091 | 0.080 | 0.073 | 0.170 |
| (Z) Thermal expansion (%) of filler at 800° C.* | | 0.215 | 0.165 | 0.150 | 0.143 | 0.155 | 0.167 | 0.180 |
| Difference of thermal expansion (Y) − (X) (%) | | 0.112 | 0.092 | 0.024 | 0.023 | 0.012 | 0.005 | 0.102 |
| Difference of thermal expansion (Z) − (X) (%) | | 0.147 | 0.097 | 0.082 | 0.075 | 0.087 | 0.099 | 0.112 |
| Thermal expansion (%) of matrix at 800° C. | | 0.131 | 0.077 | 0.071 | 0.071 | 0.073 | 0.080 | 0.115 |
| Cracks on, (thermal shock resistance), heat regenerator when removed from electric furnace at** | 650° C. | exist | none | none | none | none | none | exist |
| | 700° C. | exist | exist | none | none | none | exist | exist |
| Leakage (kg/sec · $m^2$) under 1.4 kg/$cm^2$ | | 0.029 | 0.025 | 0.023 | 0.020 | 0.019 | 0.019 | 0.019 |

Notes:
*Measurement was taken on 55 mm long fired test pieces.
**Thermal shock resistance was determined by checking cracks when the heat regenerator was removed from an electric furnace at 650 or 700° C.

As can be seen from Table 4, the reference Specimens R No. 1 and R No. 2 were found to result in considerably larger thermal expansion of matrix and inferior thermal shock resistance as compared with those obtained by the invention.

Figure 7:
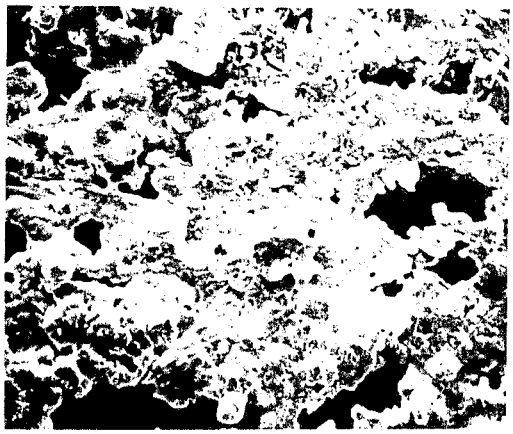
FIG. 7 is a photograph of a scanning electron microscope secondary electron image of the surface of a matrix partition wall of Specimen No. 3 of the invention, as shown in Table 4 of Example 2, showing the conditions before applying a filler substance thereto (with a magnification of 800 times)
Figure 8:
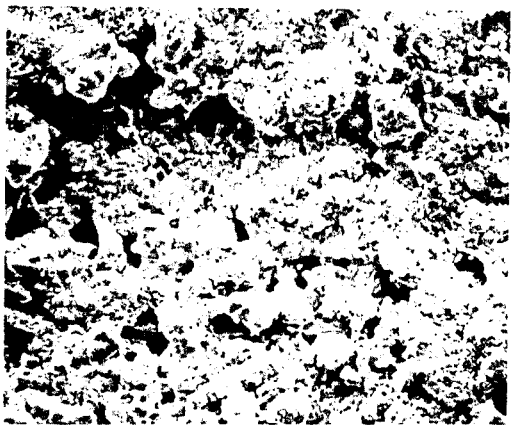
FIG. 8 is a photograph of a scanning electron microscope secondary electron image of the surface of the matrix partition wall of Specimen No. 3 of the invention, as shown in Table 4 of Example 2, showing the conditions after the open pores thereof are sealed with the filler thereto (with a magnification of 800 times).

To check the manner in which the filler substances cling to or are applied to the surfaces of the matrix partition walls, electronic microscope pictures were taken at the surface of the matrix partition walls of the Specimen No. 3 of the invention as listed in Table 4. FIG. 7 shows an example of the electronic microscope pictures of the above-mentioned surface of the matrix partition walls of Specimen No. 3 before application the filler thereto, while FIG. 8 shows as example of the electronic microscope pictures of said surface after being sealed with the filler applied thereto.

EXAMPLE 3

Thirty-five pieces of the cordierite matrix segment Specimen b of Table 1 of Example 1 were prepared, and they were suitably machined at outer periphery and end surfaces thereof, and a pasty bonding material was applied to certain surfaces of the matrix segment pieces so that the thickness of the bonding material would be about 1.5 mm, so that they were bonded at said certain surfaces and a bonded matrix body of unitary structure was formed. The pasty bonding material consisted of Chinese talc, calcined Chinese talc, Georgia kaolin, calcined Georgia kaolin, and alumina. After being thoroughly dried, the bonded matrix body of unitary structure was placed in an airtight vessel which could be evacuated, and a slip of a filler was introduced into the vessel so as to dip the bonded matrix body in the slip for about 60 seconds, and then the slip was withdrawn from the vessel while evacuating the vessel, whereby the filler was applied to the bonded matrix body. The slip consisted of a filler containing 80 parts by weight of finely pulverized cordierite with a particle size of smaller than 44 μm, 20 parts by weight of the ceramic powder particles B convertible to glass substances upon firing as shown in Table 3, and 60% of water. The amount of the filler applied was found to be 24.5%. After application the filler, the bonded matrix body was fired with a maximum temperature of 1,390° C. for five hours, so as to produce a rotary cordierite heat regenerator having diameter of 700 mm and a thickness of 70 mm. The thermal expansion of the filler substances and the bonding material were measured in a manner similar to that of Examples 1 and 2. Table 5 shows the result of the measurements of various properties; namely, the thickness of the matrix partition wall and the thermal expansion of the heat regenerator, the leakage in the heat regenerator, and the thermal expansion of the bonding material and the filler substances. The thus produced heat regenerator proved to have excellent performance characteristics.

TABLE 5

| Specimen | | Example 3 |
|---|---|---|
| (X) Thermal expansion (%) of matrix segment at 800° C. before applying filler | | 0.057 |
| Properties after firing at 1,390° C. for 5 hours | Thickness of matrix partition wall (mm) | 0.12 |
| | (Y) Thermal expansion (%) of bonding material at 800° C.* | 0.070 |
| | (Z) Thermal expansion (%) of filler at 800° C.* | 0.137 |
| | Difference of thermal expansion (Y) − (X) (%) | 0.013 |
| | Difference of thermal expansion (Z) − (X) (%) | 0.080 |
| | Thermal expansion (%) of matrix at 800° C. | 0.061 |
| | Leakage (kg/sec · $m^2$) under 1.4 kg/$cm^2$ | 0.021 |

Notes:
*Measurement was taken on 55 mm long fired test pieces.

As described in detail in the foregoing, in the rotary cordierite heat regenerator according to the present invention, open pores of partition walls of the honeycomb structural matrix or member, said partition walls defining channels of the matrix, are sealed by a filler applied thereto, so the leakage across the partition walls is minimized, i.e., to a level of less than 0.025 kg/sec.·$m^2$ under a pressure of 138 KPa or about 1.4 kg/$cm^2$, whereby the heat exchange efficiency of the heat regenerator is improved remarkably. Besides, the difference of thermal expansion between the filler and the porous cordierite matrix is kept below 0.1% at 800° C., so that the heat regenerator of the invention has about the same thermal expansion and about the same resistance to thermal shock impact as those of conventional porous cordierite matrice.

Further, the open pores of partition walls are almost exclusively sealed with the filler and the applying of the filler does not cause any substantial changes in the thickness of the matrix partition walls and the cell pitch thereof. Accordingly, the net opening area of the honeycomb structural matrix is kept intact, so as to prevent any adverse effects such as an increased pressure loss or a reduction of the heat exchange efficiency.

Moreover, the present invention provides an efficient method of producing the rotary cordierite heat regnerator, which is of heat accumulator type and has a high gastightness.

In short, the rotary cordierite heat regenerator of heat accumulator type with a high gastightness according to the present invention has an excellent resistance to thermal shock, a small pressure loss, and a high heat exchange efficiency, so that the heat regenerator is very useful as a rotary heat exchanger of accumulator type for internal combustion engines and external combustion engines such as gas turbine engines and Stirling's air engines and also as various industrial heat exchangers for energy saving or the like. The rotary heat regenerator of the invention is also very useful in applications where a low leakage across the matrix partition walls is required.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A method of producing a rotary cordierite heat regenerator having a high gastightness, comprising the steps of shaping and firing a cordierite honeycomb structural body, said honeycomb structural body having a plurality of porous partition walls defining channels in the honeycomb structural body, filling open pores in substantially all of said plurality of porous partition walls with a filler substance, said filler substance and said partition walls having a difference in thermal expansion of less than 0.1% at 800° C., after firing, and firing the honeycomb structural body with the filler substance applied thereto at a temperature within a range of 1,350°-1,430° C.

2. The method as set forth in claim 1, wherein said filler substance comprises cordierite powder particles and ceramic powder particles, said ceramic powder particles being convertible to a glass substance after firing thereof.

3. The method as set forth in claim 2, wherein said filler substance is applied onto open pores in the partition walls by dipping said honeycomb structural body into a slip containing cordierite powder particles, and subsequently dipping the honeycomb structural body into a slip containing ceramic powder particles, said ceramic powder particles being convertible to a glass substance after firing thereof.

4. The method as set forth in claim 2, wherein said filler substance is applied onto open pores in the partition walls by dipping said honeycomb structural body into a slip containing a mixture of cordierite powder particles and ceramic powder particles, said ceramic powder particles being convertible to a glass substance after firing thereof.

5. The method as set forth in claim 1, wherein said filler to be filled into open pores of said partition walls consists of powder particles having a grain diameter of less than 44 m.

6. A method of producing a rotary cordierite heat regenerator having a high gastightness, comprising the steps of shaping and firing cordierite matrix segments of a honeycomb structural body, said honeycomb structural body having a plurality of porous partition walls defining channels in the matrix segments of the honeycomb structural body, filling open pores in substantially all of said plurality of porous partition walls with a filler substance, said filler substance and said partition walls having a difference in thermal expansion of less than 0.1% at 800° C., after firing, applying a bonding material on selected portions of said matrix segments to bond said matrix segments into a bonded matrix body of a unitary honeycomb structural body, and after firing, said bonding material contains cordierite as a major crystalline phase ingredient thereof, wherein a difference of thermal expansion between said bonding material and said matrix segments after firing is less than 0.1% at 800° C., and firing the bonded matrix body of the unitary honeycomb structural body at a temperature within a range of 1,350°-1,430° C.

7. A method of producing a rotary cordierite heat regenerator having a high gastightness, comprising the steps of shaping and firing cordierite matrix segments of a honeycomb structural body, said honeycomb structural body having a plurality of porous partition walls defining channels in the honeycomb structural body, applying a bonding material on selected surface portions of said matrix segments to bond said segments into a bonded matrix body of a unitary honeycomb structural body, whereby after firing, said bonding material contains cordierite as a major crystalline phase ingredient thereof, said bonding material having a difference in thermal expansion of less than 0.1% at 800° C., after firing, filling open pores in substantially all of said plurality of partition walls with a filler substance, whereby a difference of thermal expansion between said filler and said partition walls is less than 0.1% at 800° C., after firing, and firing the bonded matrix body of unitary honeycomb structural body at a temperature within a range of 1,350°-1,430° C.

* * * * *